United States Patent [19]

Miura et al.

[11] 4,432,697

[45] Feb. 21, 1984

[54] ROTOR OF AXIAL-FLOW MACHINE

[75] Inventors: Haruo Miura; Yoshiaki Abe, both of Ibaraki, Japan

[73] Assignee: Hitach, Ltd., Tokyo, Japan

[21] Appl. No.: 365,597

[22] Filed: Apr. 5, 1982

[30] Foreign Application Priority Data

Apr. 10, 1981 [JP] Japan ..... 56/53182

[51] Int. Cl.[3] ..... F01D 5/06

[52] U.S. Cl. ..... 416/198 A; 416/201 R; 416/215; 415/199.5

[58] Field of Search ..... 416/198 A, 200 A, 201 R, 416/215, 270 R, 204 A, 205, 206, 217 A, 214 A, 219 R, 221, 223 R, 223 A, 223 B, 224, 239, 193 A, 178, 134; 415/199.5

[56] References Cited

U.S. PATENT DOCUMENTS

| | | | |
|---|---|---|---|
| 2,669,383 | 2/1954 | Purvis et al. | 416/221 |
| 2,925,250 | 2/1960 | Whitehead | 416/215 |
| 3,603,702 | 8/1971 | Jensen | 416/220 |
| 3,778,191 | 12/1973 | Brockmann | 416/215 |
| 3,902,824 | 8/1975 | Sauer | 416/215 |
| 3,954,350 | 5/1976 | Zahring | 416/215 |
| 4,127,359 | 11/1978 | Stephan | 416/198 A |

FOREIGN PATENT DOCUMENTS 49-8805 of 1974 Japan .

*Primary Examiner*—Philip R. Coe
*Assistant Examiner*—Michael Knick
*Attorney, Agent, or Firm*—Antonelli, Terry & Wands

[57] ABSTRACT

A rotor of an axial-flow machine including a plurality of spacer members arranged peripherally of the rotor for providing a channel on the surface of the rotor. The spacer members are located in a manner to straddle the forward stage disc section and the rearward stage disc section, to enable each rotor blade to be replaced individually with a new one by mounting and removing the rotor blade axially of the rotor. The rotor of the axial-flow machine has improved reliability and flow performance.

10 Claims, 6 Drawing Figures

ROTOR OF AXIAL-FLOW MACHINE

BACKGROUND OF THE INVENTION

1. Field of the Invention

This invention relates to rotors of axial-flow machines, such as axial-flow compressors, axial-flow turbines, etc., and more particularly it is concerned with an axial-flow machine of the type having rotor blades assembled and disassembled axially on its rotor, wherein a removable spacer is mounted between the rotor blade mounting portions of the rotor to enable each rotor blade to be replaced with a new one as desired without requiring disassembling of the rotor.

2. Description of the Prior Art

In a stacked rotor type of axial-flow machine the discs of the rotor each have a recess on an inner side thereof, with the disc being stacked one over another in a suitable number of stages to meet the fluid performance and clamped together by stacking-bolts into a unitary structure. In the stacked-rotor type axial-flow machine, the rotor blades can be axially mounted and removed without disassembling the rotor by arranging the discs and the rotor blades in such a manner that the spacing interval between the discs is about twice as large as a length of a dovetail for receiving each rotor blade and a clearance of a size equal to the length of the dovetail is formed between the discs to thereby provide a removal allowance for the rotor blade. This allowance enables each rotor blade to be mounted and removed axially when desired. A rotor construction in which the rotor blades are mounted axially has high radial restraining strength and is suitable for use with an axial-flow machine in which high centrifugal forces are exerted on the rotor blades, because each rotor blade is individually mounted, as compared with a rotor construction in which the rotor blades are peripherally mounted. Also, the rotor of this construction has high damping effect with respect to the vibration of the rotor blades because the rotor blades do not restrain one another.

In an axial-flow machine, fluid performance is greatly affected by the size of a clearance between the ends of the rotor blades and the casing and the size of a clearance between the ends of stator blades and the surface of the rotor. The smaller these clearances, the higher the efficiency of the axial-flow machine.

Previously, in order to reduce the clearance between the ends of the stator blades and the surface of the rotor, an attempt has been made to form an extension of the dovetail section of each disc for mounting a rotor blade axially both to the forward and rearward stage sides so as to provide a channel on the surface of the rotor juxtaposed against the stator blades. This construction has, however, the disadvantage that, since the flanges overhang axially, the flanges undergo great deformation when exposed to centrifugal forces as the rotor rotates. This makes it necessary to provide a clearance between the stator blades and the flanges which is large enough to accommodate the deformation. This clearance is unable to have its size reduced. Also, deformation of the flanges, due to centrifugal forces, causes the surface (channel) of the rotor to become irregular, so that the flow of fluid moving therealong is disturbed and efficiency of the axial-flow machine is reduced. The above-noted construction is unable to provide an allowance for a rotor blade removing, thereby making it impossible to axially mount and remove the rotor blade without disassembling the rotor.

In another type of rotor of an axial-fow machine, a plurality of stator blades are assembled to the inner peripheral surface of the casing, with the ends of the stator blades being connected together by a shroud which is formed at its outer peripheral surface with a channel and at its inner peripheral surface with a labyrinth to keep the handled fluid from leaking from the rearward stage to the forward stage. In this type of rotor, it is possible to mount and remove each single rotor blade without disassembling the rotor by increasing the width of the shroud over and above the axial length of the dovetail. However, since leaks of the handled fluid from the rearward stage to the forward stage are only reduced in amount by a labyrinth, the fluid leaks from the rearward stage to the forward stage and blows out onto the rotor surface, thereby bending the flow of a portion of the fluid in the channel that is near the rotor surface and causing a reduction in efficiency.

In still another type of rotor construction disclosed, for example, in Japanese Laid Open Patent Application No. 8805/74, a spacer is mounted between the mounting portions of the adjacent rotor blades and the spacers are bolted to the rotor. By virtue of this arrangement, it is possible to mount and remove each single rotor blade without disassembling the rotor in this construction. However, a disadvantage of this construction resides in the fact that it is low in reliability because the spacers exposed to centrifugal forces are only bolted to the rotor. Moreover, the spacers themselves tend to undergo radial deformation at their axial opposite ends due to exposure to centrifugal forces, thereby adversely affecting the fluid efficiency.

SUMMARY OF THE INVENTION

An object of this invention is to provide a rotor for an axial-flow machine comprising spacer means including spacer members each located between the adjacent rotor blade mounting portions to positively avoid dislodging of the spacer means outwardly of the rotor, thereby increasing the performance reliability of the machine.

Another object is to provide a rotor of an axial-flow machine enabling each rotor blade to be individually mounted and removed without requiring disassembling of the rotor.

Still another object is to provide a rotor of an axial-flow machine wherein fluid performance is improved to increase operational efficiency.

To accomplish the aforesaid objects, the invention provides, in a rotor of an axial-flow machine comprising rotor blades arranged in a stator blade lattice, with each of the blades being located on a disc section of the rotor in a manner so to be individually mounted and removed as desired axially of the rotor a plurality of shoulders are located peripherally of the rotor on opposite outer peripheral surfaces of the adjacent disc sections in spaced juxtaposed relationship. Spacer means comprising a plurality of spacer members arranged peripherally of the shoulders, each with spacer means being located in a space defined between the adjacent shoulders. The spacer means comprise locking means engaging the inner peripheries of the shoulders to avoid dislodging of the spacer members outwardly of the rotor, and an outer surface means is located at a portion of the surface of the rotor in a spaced juxtaposed relationship to the end of each stator blade to provide a channel thereon.

According to the invention, there is also provided, in a rotor of an axial-flow machine comprising rotor blades arranged in a stator blade lattice and each located on a disc section of the rotor in a manner to be individually mounted and removed as desired axially of the rotor wherein the rotor is a stacked-rotor comprising a plurality of discs arranged in a stack and interconnected by stacking-bolts into a unitary structure, a plurality of circumferential grooves are located peripherally of the rotor on opposite outer peripheral end surfaces of the adjacent disc sections in a spaced juxtaposed relationship. Spacer means including a plurality of spacer members are located peripherally of the circumferential grooves and comprise an outer surface means located at a portion of the surface of the rotor in spaced juxtaposed relationship to the end of each stator blade to provide a channel thereon. Projecting portions are located peripherally of the circumferential grooves and each are divided into a plurality of elements to be successively fitted therein to keep the spacer means from being dislodged outwardly of the rotor by engaging the outer peripheral shoulder of each circumferential groove. Cutout means are formed at least at one portion of the inner peripheral shoulders of the circumferential grooves and having a peripheral dimension slightly greater than the peripheral dimension of each spacer member for enabling a successive inserting the spacer members in the circumferential grooves, and dislodging preventing means are provided for preventing dislodging of the spacer member finally inserted in the circumferential grooves.

Additional and other objects, features and advantages of the invention will become more apparent from the following description when considered in conjunction with the accompanying drawings.

DESCRIPTION OF THE PREFERRED EMBODIMENT

Figure 1:
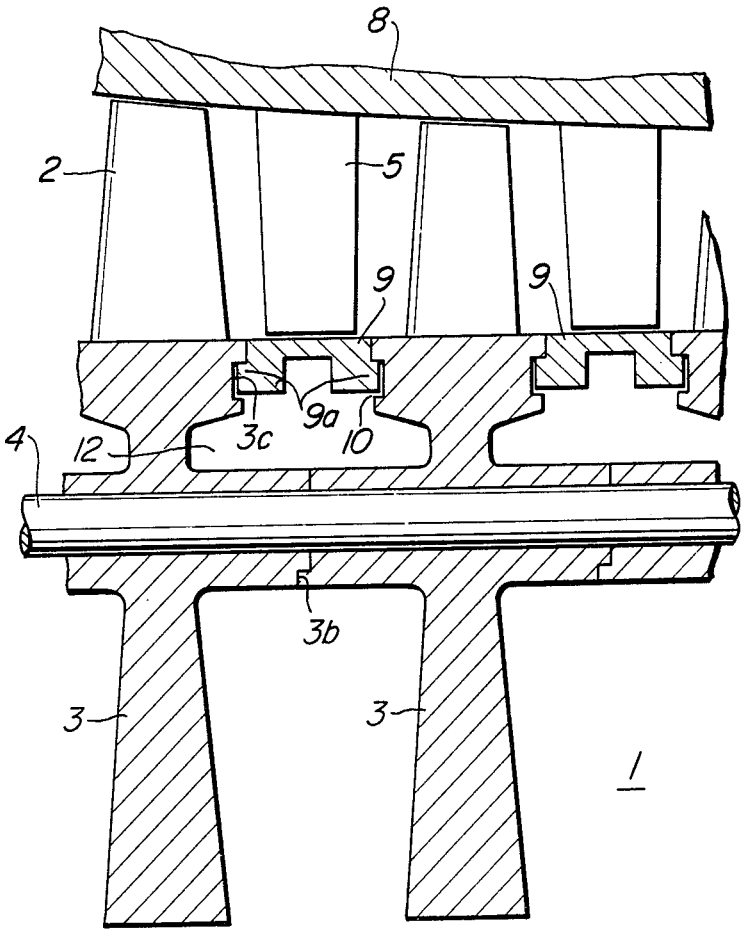
FIG. 1 is a vertical cross sectional view of the basic portions of a stacked rotor of an axial flow compressor constructed in accordance with one embodiment of the invention.

Referring now to the drawings wherein like reference numerals are used throughout the various views to designate like parts and, more particularly, to FIG. 1, according to this Figure, a stacked-rotor of an axial-flow compressor includes a rotor 1 formed of a plurality of discs 3 each formed with a recess on an inner side with the discs 3 being connected together by stacking-bolts 4 into a unitary structure. The number of discs 3 are determined by the number required for maintaining fluid performance at a desired level. Each disc 3 is formed with an interfitting portion **3*b* for positioning the discs 3 radially of the rotor 1, with the discs 3 being stacked while being interfitted at the interfitting portions 3*b* into a unitary structure. The stacked-rotor construction described hereinabove offers the advantages that the weight and moment of inertia ($GD^2$) of the rotor 1 can be reduced. Each of the discs 3 are formed on a circumference thereof, with a dovetail groove for enabling an axial receiving and removal of a rotor blade 2. The rotor blade 2 is interposed between stator blades 5 attached to a casing 8, with a spacing between the peripheral ends of the discs 3 being greater than a length of the dovetail groove, to allow each rotor blade 2 to be mounted and removed without disassembling the rotor 1**.

Figure 2:
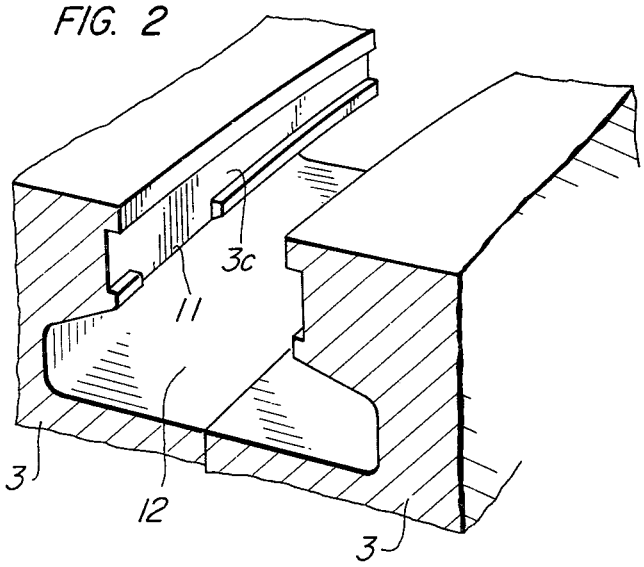
FIG. 2 is a perspective cross-sectional view of the basic portions of the rotor shown in FIG. 1, showing in detail the configuration of the circumferential grooves of the rotor.

Spacer members 9 are located at a portion of the surface of the rotor 1 in spaced juxtaposed relationship to the end of each stator blade 5 to form a channel thereon. The spacer members 9, constituting spacer means, are arranged peripherally and removably mounted on the rotor 1, with each spacer member 9 straddling a rotor disc mounting portion of a forward stage disc section and a rotor mounting portion of a rearward stage disc section of the rotor 1 so that the spacer members 9 are locked against movement outwardly of the rotor 1. Each disc 3 is located on one of the disc sections of the rotor 1 and formed at the outer peripheral surfaces with circumferential grooves **3*c* for receiving the spacer members 9. As shown in FIGS. 1 and 2, the circumferential grooves 3*c* at the adjacent discs 3 are in spaced juxtaposed relationship, and each spacer member 9 is formed on opposite sides with projecting portions 9*a* each received in one of the circumferential grooves 3*c* of the adjacent discs 3 and adapted to engage an outer peripheral shoulder of one of the circumferential grooves 3*c* to serve as locking means for avoiding dislodging of the spacer means outwardly of the rotor 1. By successively inserting the projecting portions 9*a* of the spacer members 9 in the circumferential grooves 3*c* at the adjacent discs 3, each spacer member 9 can be mounted in the rotor 1 in a manner so as to engage one another peripherally of the rotor 1 and straddle the forward stage disc section and the rearward stage disc section, to thereby position the spacer members 9 radially of the rotor 1. During rotation of the rotor 1 and when it is stationary, the spacer members 9 are restrained from outward movement and prevented from being dislodged from the rotor 1. During rotation of the rotor 1, an outer surface of each spacer member 9 is contiguous with the surface of the rotor 1 to provide a smooth channel thereon. The projecting portions 9*a* of the spacer members 9 have a thickness slightly smaller than the width of the circumferential grooves 3*c* at the discs 3, so that a clearance 10 is formed between one side wall of each circumferential groove 3*c* and the bottom of each projecting portion 9*a* during rotor rotation as shown in FIG. 1**.

Figure 3:
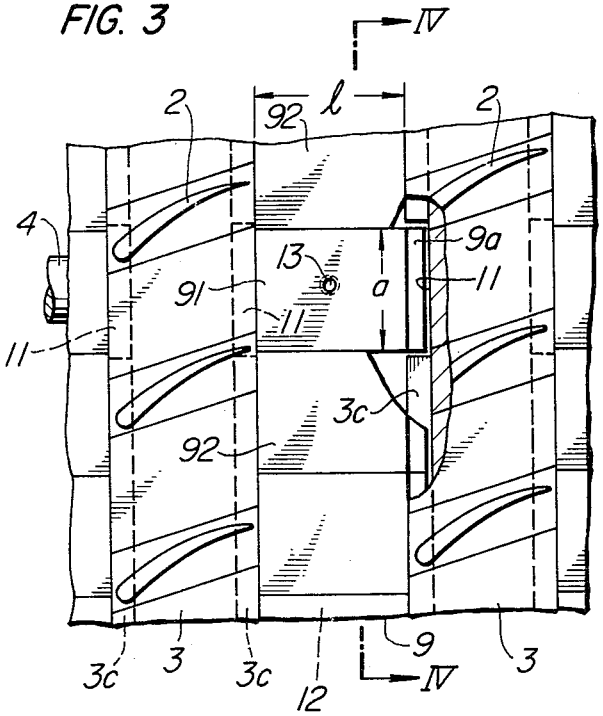
FIG. 3 is a plan view of the rotor shown in FIG. 1.
Figure 4:
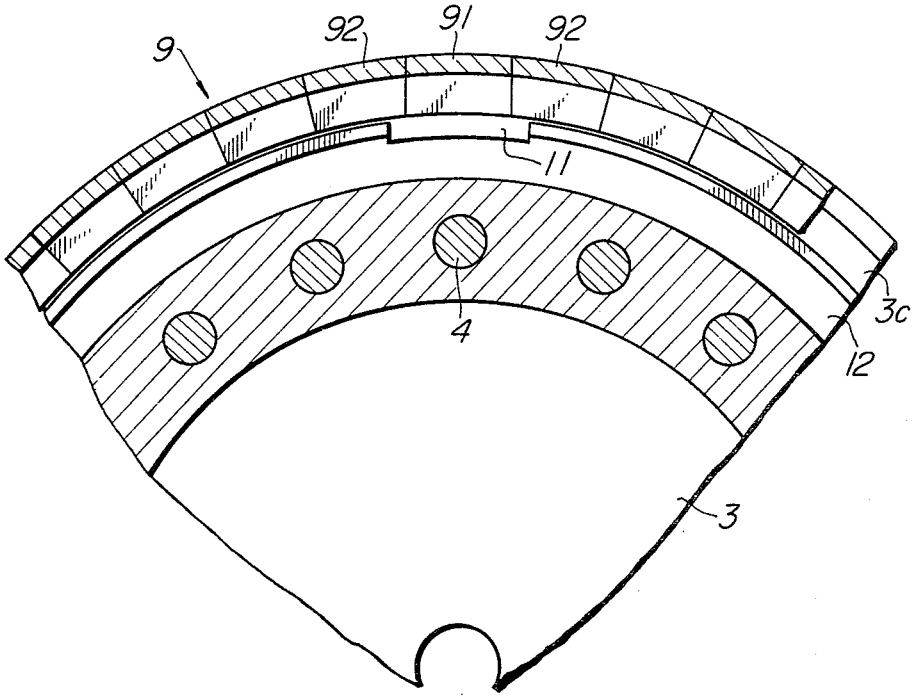
FIG. 4 is a cross-sectional taken along the line view IV—IV in FIG. 3.
Figure 5:
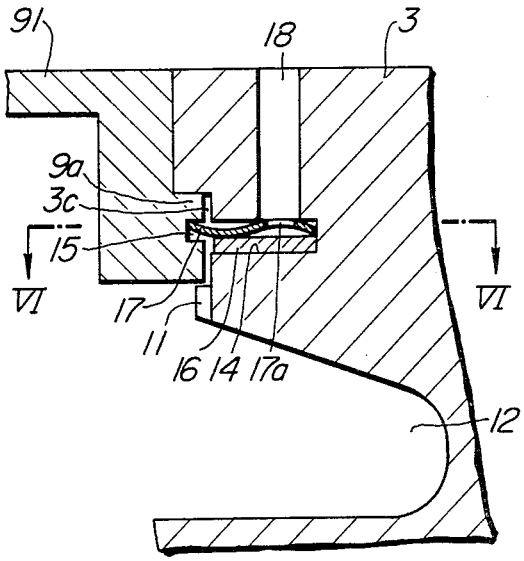
FIG. 5 is a vertical cross sectional view, on an enlarged scale, of the basic portions of the rotor shown in FIG. 1, in explanation of dislodging preventing means for the spacer means.

The process for inserting the spacer members 9 will now be described by referring to FIG. 2 which shows, in detail, the configuration of the circumferential grooves **3*c* of the rotor 1. As shown in FIG. 2, the circumferential grooves 3*c* at the discs 3 are each formed with at least one cutout 11 in one side wall or shoulder thereof, the cutout 11 having a peripheral length slightly greater than the peripheral length of the spacer member 9. As shown in FIG. 3, the spacers 9 each have a peripheral length a smaller than the spacer l between the outer peripheral ends of the forward stage disc 3 and rearward stage disc 3**. After the plurality of discs 3 are connected together by the stacking-bolts 4, the spacer members 9 are inserted in a space 12 (FIG. 2) between the adjacent discs 3. Since the peripheral length a of the peripherally arranged spacer members is smaller than the spacing l between the outer peripheral ends of discs 3, the spacer member 9 can be readily inserted in the space 12 by rotating the spacer member 9 through 90 degrees so that the peripheral ends of the spacer member 9 may be oriented axially. After the spacer member 9 is inserted in the space 12, the spacer member 9 is rotated through 90 degrees to return same to a regular position in which its peripheral ends is oriented peripherally of the rotor 1. Then the spacer member 9, inserted in the space 12, is moved radially upwardly to be fitted in the circumferential grooves 3c where it is slidably moved peripherally of the rotor 1. In this way, one spacer member 9 after another is fitted in the circumferential grooves 3c as shown in FIG. 4. In FIG. 4, the spacer member 91, inserted finally in the circumferential grooves 3c from the cutouts 11 has its peripheral ends shaped such that they are parallel to the radial axis extending through the center of the last spacer member 91, and the spacer members 92 adjacent the last spacer member 91 are shaped such that one end thereof adjacent the last spacer member 91 is parallel to the peripheral ends of the spacer member 91. Thus, when the last spacer member 91 is fitted in the circumferential grooves 3c, a substantially reactangular space of a length equal to the peripheral length of the last spacer member 91 is defined between the two spacer members 92 to be disposed adjacent the last spacer member 91, and the last spacer member 91 is inserted from this rectangular space obliquely into the space 12 between the discs 3, where the last spacer member 91 is moved radially upwardly in a position in which the last spacer member 91 is parallel to the rotor axis and oriented normally. This completes the fitting of all the spacer members 9 in the circumferential grooves 3c of the rotor 1 without any play. In the embodiment shown and described hereinabove, each spacer member 9 is rotated through 90 degrees in the space 12. It is easy to provide the space 12 with an area large enough to allow the spacer member 9 to rotate therein, particularly when the inner shoulder of the circumferential groove 3c has a smaller height than the outer shoulder thereof as shown in FIGS. 1 and 5. In the foregoing description, the last spacer member 91 has been described as being obliquely inserted in the space 12. However, by inserting the last spacer member 91 in the space 12 before the spacer members 92 are fitted in the circumferential grooves 3c and thereafter fitting the spacer members 92 in the circumferential grooves 3c, it is possible to insert the spacer member 91 in the space 12 without turning it obliquely. It is possible to insert all the spacer members 9 obliquely into the space 12. When this is the case, it is not necessary to rotate the spacer members 9 through 90 degrees in the space 12 and it is not essential to reduce the peripheral length a of each spacer member 9 below the spacing l between the peripheral ends of the discs 3. The last spacer member 91 may be formed at its outer surface with a threaded hole 13, as shown in FIG. 3, for attaching a jig to the spacer member 91 to insert the latter in the space 12 by the jig, thereby facilitating the operation of moving the spacer member 91 upwardly to its regular position.

Figure 6:
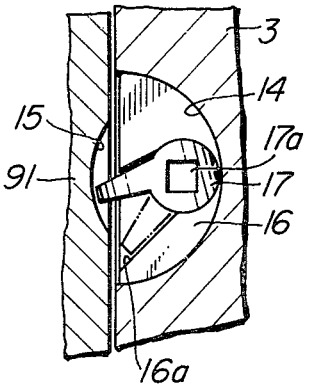
FIG. 6 is a cross-sectional taken along the line view VI—VI in FIG. 5.

One example of means for preventing dislodging of the last spacer member 91 will be described by referring to FIGS. 5 and 6. All the spacer members 9 except the last spacer member 91 are snugly fitted in the circumferential grooves 3c and free from the risk of being dislodged therefrom. However, the last spacer member 91 is located in the cutouts 11 of the circumferential grooves 3c, so that there is the risk of it being dislodged therefrom into the central portion of the rotor 1. As shown in FIGS. 5 and 6, a segmental slit 14 is formed in the disc 3 in a portion facing the circumferential groove 3c where the cutout 11 is formed, and an arcuate slit 15 is formed in a portion of the spacer member 91 to be located in the cutout 11 which is positioned against the slit 14. The slit 14 has a segmental member 16 formed with a recess 16a opening toward the arcuate slit 15 for mounting a corrugation spring 17 in a manner to rotate within the recess 16a. The corrugation spring 17 is formed with a square opening 17a for inserting a tool therein, and the corrugation spring 17 rotates about the square opening 17a. The discs 3 is formed with a tool inserting hole 18 opening at the outer peripheral surface of the disc 3 and extending to the square opening 17a of the corrugation spring 17 in the slit 14. The spacer members 9 are successively fitted in the circumferential grooves 3c while the corrugation spring 17 is disposed in a dash-and-dot line position shown in FIG. 6, and after the last spacer member 91 is mounted in the cutout 11, a tool is inserted into the hole 18 and the square opening 17a to rotate the corrugation spring 17 to a solid line position shown in FIG. 6. This brings the forward end of the corrugation spring 17 into engagement in the arcuate slit 15, so that the last spacer member 91 can be positively kept from being dislodged from the position in the circumferential grooves 3c into the central portion of the rotor 1. The corrugation spring 17 is kept in engagement with the portions of the disc 3 above and below the slit 14 by its biasing force, so that the corrugation spring 17 is kept in place unless it is rotated as by a tool.

When it is desired to remove the spacer members 9 from the rotor 1, the operation for mounting the spacer members 9 in the rotor 1 described hereinabove has only to be performed in reverse. More specifically, a tool is inserted into the hole 18 to rotate the corrugation spring 17 from its solid line position to its dash-and-dot line position shown in FIG. 6, to thereby remove the spacer member 91. Then each spacer member 9 is moved in sliding movement along the circumferential grooves 3c to be disassembled therefrom at the cutouts 11. When it is desired to replace any one of the rotor blades 2 by a new one, the spacer member 91 is first removed and then each spacer member 9 is moved in sliding movement for a distance corresponding to the peripheral length a of the spacer member 9 so that the rotor blade 2 desired to be replaced has no spacer member 9 positioned thereagainst. Thus, the desired rotor blade 2 can be removed and a new rotor blade can be mounted. By restoring the rotor blades 9 to their original positions, it is possible to effect replacements of the rotor blades 2 without disassembling the rotor 1. The last spacer member 91 is equal in number to the cutout 11 formed in each circumferential groove 3c. Therefore, the means for preventing dislodging of the last spacer member 91 should be of the same number as the last spacer member 91.

The means for preventing dislodging of the last spacer member 91 is not limited to the specific embodiment shown and described hereinabove, and the last spacer member 91 may be prevented from being dislodged by some other means. For example, a coil spring may be mounted between the inner peripheral surface of the spacer member 91 and the rotor 1, or the spacer members 9 may be displaced peripherally a distance corresponding to half the peripheral length a of the spacer member 9, to prevent dislodging of the last spacer member 91. Also, by fitting the last spacer member 91 in such a manner that it is maintained at opposite ends thereof in frictional engagement with the ends of the adjacent spacer members 92, to prevent dislodging of the spacer member 91 by the frictional dragging thereof on the adjacent spacer members 92.

In the embodiment shown and described hereinabove, the spacer members 9 may be formed of material, such as aluminum, titanium, fiber-reinforced plastics, etc., which is lighter in weight than the material of the discs 3. This reduces the centrifugal forces acting on the spacer members 9 and enables the spacer members 9 to be held in place with increased reliability. In addition, deformation of the spacer members 9 themselves by the centrifugal forces is reduced, so that the outer surface of the spacer member 9, providing a channel thereon, becomes smoother, thereby contributing to improved fluid performance.

The operation of the embodiment shown and described hereinabove and the effects achieved thereby will be summarized.

(1) Each spacer member 9, forming a channel, straddles the rotor blade mounting portion of the forward stage disc section and the rotor blade mounting portion of the rearward stage disc section and is locked against movement outwardly of the rotor 1 through the circumferential grooves 3*c* and the projecting members 9*a*. By this arrangement, each spacer member 9 is positively kept from being dislodged axially of the rotor 1 by centrifugal forces, thereby increasing reliability in performance.

(2) Each spacer member 9 is supported at opposite ends with respect to the outer end of the rotor 1, so that radial deformation of each spacer member 9 of the rotor 1 by centrifugal forces is minimized. This enables the channel formed by each spacer member 9 to be kept from becoming irregular due to centrifugal forces and keeps the channel smooth and undisturbed. Also, the clearance between the end of each stator blade 5 and the surface of each spacer member 9 can be minimized, to thereby greatly improve fluid performance and increase efficiency.

(3) The spacer means includes a plurality of spacer members 9 arranged peripherally of the rotor 1. Thus, even if centrifugal forces are exerted on each spacer member 9, no internal stress is produced in the spacer means itself. Each spacer member 9 can be mounted and removed without disassembling the rotor 1, so that each rotor blade 2 can be mounted and removed without disassembling the rotor 1. Thus, when the rotor blades 2 suffer local damage, the need to replace the rotor 1 with a new rotor or to replace the damaged rotor blades 2 with new rotor blades by disassembling the rotor 1 is eliminated. It is possible to replace any rotor blade 2 as desired merely by removing one or two spacer members 9 without disassembling the rotor 1, thereby greatly reducing production and operating costs.

(4) Each rotor blade 2 is independently supported by a rotor mounting portion of a disc section. This permits a mounting method of high damping effect with respect to the vibration of the rotor blade 2 during operation to be adopted. Thus, the rotor blades 2 have high strength with regard to radial restraint.

The invention has been described by referring to an embodiment in which the rotor 1 is a stacked-rotor of an axial-flow compressor. However, the invention is not limited to this specific form of embodiment and can have application in an integral rotor so long as the rotor has disc sections to allow the rotor blades to be axially mounted and removed. The invention can also have application in an axial-flow turbine. It is to be understood that these applications are all included in the scope of the invention. In the embodiment shown and described hereinabove, the spacer members 9 are supported by the circumferential grooves 3*c* and the projecting portions 9*a*. However, the invention is not limited to this arrangement for supporting the spacer members 9; what is important is that the disc sections each have a shoulder and each spacer member has locking means engaging the shoulders, to allow the spacer members to engage one another outwardly of the rotor 1.

From the foregoing description, it will be appreciated that according to the invention the rotor of the axial-flow machine according to the invention is provided with spacer means forming a channel on the surface of the rotor juxtaposed against the stator blades, the spacer means being mounted such that it stradles the disc sections of the forward and rearward stages. Thus, the rotor of the axial-flow machine according to the invention has high performance reliability. The invention enables each rotor blade to be mounted and removed individually without disassembling the rotor, and improves fluid performance, to thereby greatly increase efficiency.

What is claimed is:

1. A rotor of an axial-flow machine comprising a plurality of rotor blades arranged in a stator blade lattice and supported on adjacent disc sections in a manner to be mounted and axially removed individually as desired, wherein said rotor includes a plurality of circumferential grooves located on opposite outer peripheral end surfaces of adjacent disc sections in a space juxtaposed relationship, each of said circumferential grooves includes shoulder means located peripherally of the rotor, opposed end surfaces of said shoulder means of adjacent disc sections defining a space therebetween, spacer means adapted to be located in the space defined between the shoulder means, said spacer means including a plurality of spacer members arranged peripherally of the shoulder means and comprising locking means adapted to engage the shoulder means at an inner side thereto to keep the spacer means from being dislodged outwardly of the rotor, and an outer surface means disposed in spaced juxtaposed relationship to the end of each stator blade for forming a channel on the surface of the rotor, said locking means including projecting portions provided on opposite sides of each of said spacer members and adapted to engage said shoulder means, at least one cut out is formed in an inner side wall of each of said circumferential grooves for enabling a successive insertion of said spacer members into said circumferential grooves, each of said cut outs has a length slightly greater than a peripheral length of each of said spacer members, said spacer members include final spacer members each having opposite peripheral ends extending parallel to a radial axis extending through a center point of the respective final spacer members inserted into said circumferential groove through said cutouts, and wherein the respective spacer members located adjacent said respective final spacer members each have an end surface adjacent said final spacer member extending in parallel to the respective end surfaces of the final spacer members.

2. A rotor of an axial-flow machine as claimed in claim 1, wherein said rotor comprises a stacked-rotor including a plurality of disc sections stacked one over another and interconnected by stacking-bolts.

3. A rotor of an axial-flow machine as claimed in claim 1, wherein said axial-flow machine comprises an axial-flow compressor.

4. A rotor of an axial-flow machine as claimed in claim 1, wherein said spacer means is formed of material lighter in weight than the material of the disc sections.

5. A rotor of an axial-flow machine as claimed in claim 1, wherein the peripheral length of each said spacer member is smaller than the spacing between the outer peripheral ends of the adjacent disc sections.

6. A rotor of an axial-flow machine as claimed in claim 5, wherein a space is defined between the disc sections inwardly of the circumferential grooves for allowing each said spacer member to be rotated therein.

7. A rotor of an axial flow machine as claimed in claim 1, wherein each of said final spacer members is formed at an outer surface thereof with a threaded hole for threadably connecting a pull-up jig to the final spacer member.

8. A rotor of an axial-flow machine as claimed in claim 1, wherein said rotor comprises means for avoiding dislodging of the respective-final members.

9. A rotor of an axial-flow machine as claimed in claim 8, wherein said means for avoiding dislodging of the final spacer member comprises a segmental slit formed in one of the disc sections in a portion thereof facing the circumferential groove where the cutout is formed, and an arcuate slit formed in the final spacer member to be positioned against the segmental slit in the disc section, said segmental slit having a corrugated spring mounted therein and brought into engagement with said arcuate slit in the final spacer member when rotated, to thereby avoid dislodging of the final spacer member from its position in the circumferential grooves.

10. A rotor of an axial-flow machine comprising a plurality of rotor blades arranged in a stator blade lattice and supported on disc sections in a manner to be mounted and removed as desired, said rotor comprising a stacked-rotor including a plurality of discs stacked one over another and interconnected by stacking-bolts, said rotor further comprising:

a plurality of circumferential grooves located peripherally of the rotor on opposite outer peripheral surfaces of the adjacent disc sections in spaced juxtaposed relation;

spacer means including a plurality of spacer members located peripherally of said circumferential grooves and outer surfaces each forming a channel on the surface of the rotor juxtaposed against the end of each stator blade;

projecting portions each divided into a plurality of elements peripherally of each said circumferential groove to be successively fitted therein to keep said spacer means from being dislodged outwardly of the rotor by engaging the outer peripheral shoulder of each said circumferential groove;

cutout means formed at least in one portion of each said circumferential groove and having a length slightly greater than the peripheral length of each said spacer member to allow the spacer members to be successively inserted therethrough into the circumferential grooves; and means for avoiding dislodging of a last spacer member inserted in the circumferential grooves through said cutout means, said last spacer member dislodging avoiding means being located both in the last spacer member and the disc section.

* * * * *